US007472874B2

(12) United States Patent
Gross et al.

(10) Patent No.: US 7,472,874 B2
(45) Date of Patent: Jan. 6, 2009

(54) GROUND STAKE

(75) Inventors: John Gross, Vancouver (CA); Simon Walker, Surrey (CA); Frank Fan, Surrey (CA); Wei Min Zhu, Surrey (GB)

(73) Assignee: Peak Innovations Inc., Richmond (GB)

( * ) Notice: Subject to any disclaimer, the term of this patent is extended or adjusted under 35 U.S.C. 154(b) by 0 days.

(21) Appl. No.: 11/279,377

(22) Filed: Apr. 11, 2006

(65) Prior Publication Data

US 2007/0235602 A1 Oct. 11, 2007

(51) Int. Cl.
*A45F 3/44* (2006.01)

(52) U.S. Cl. ..... 248/156; 52/155; 135/118; 248/508; 239/276

(58) Field of Classification Search ..... 248/156, 248/508; 135/15; 52/23, 103, 155, 156, 52/166; 24/130; 239/276
See application file for complete search history.

(56) References Cited

U.S. PATENT DOCUMENTS 3,788,336 A * 1/1974 Steffes ..... 135/118
D377,076 S 12/1996 Adams
D379,416 S 5/1997 Adams
6,336,599 B1 * 1/2002 Herr et al. ..... 239/522
6,402,115 B1 6/2002 Groff et al.
6,745,990 B2 * 6/2004 Groff et al. ..... 248/508
6,922,942 B2 * 8/2005 Stefanutti ..... 47/47
6,938,384 B1 * 9/2005 Hodge ..... 52/155
7,097,117 B2 * 8/2006 Zur et al. ..... 239/276

* cited by examiner

*Primary Examiner*—Amy J. Sterling
(74) *Attorney, Agent, or Firm*—Mark Hopkinson

(57) ABSTRACT

A ground stake for securing ropes or other fastening elements comprises a head portion with an elevated, textured surface and two or more extending flanges above a neck portion comprising recesses and a passageway. A plurality of elongated fins, at least a portion of which are tapered, depend from the base of the head portion and terminate in a truncated blunt end, providing a stronger tip while allowing clean penetration of the ground. One or more of the fins may comprise a stiffening rib to increase the rigidity of the fin. The elevated, textured surface provides increased impact resistance and prevents slippage of a pounding implement when the stake is being driven into the ground.

10 Claims, 3 Drawing Sheets

GROUND STAKE

FIELD OF THE INVENTION

This invention relates to ground stakes of a type used to anchor vertical structures, such as tents or trees, and which are sometimes also used to anchor other elements such as in construction grading.

BACKGROUND OF THE INVENTION

One form of ground stake according to the prior art comprises a head portion with a series of tapering elongated orthogonal fins depending from the head portion as exemplified by FIGS. 1*a* and 1*b*. The head portion includes a flat surface for receiving the impact of a pounding implement for driving the stake into the ground and may also include one or more flanges to enable the attachment of ropes or other elements.

One difficulty encountered with prior art ground stakes arises from the tapering of the ground stake to a sharp point at its lowermost end. Because of the reduced effective diameter near the end, the end may be susceptible to cracking, bending or completely snapping off when driven into hard ground.

The stakes may also be subject to failure along the fins near the top of the stake. The fins at the top of the stake extend away from the axis to a greater extent than the portion of the fins near the tip of the stake and accordingly are more prone to bending or failure, particularly along the outer edges of the fins.

Ground stakes may be made of metal or plastic. The latter generally provides more structural strength than metal for the same weight of material and, depending on the choice of metal, may be lighter and more economical to produce. In addition, plastic is inherently corrosion resistant and can therefore be used instead of a separate coating or sheath or a more expensive corrosion resistant metal alloy.

However, the use of plastic for ground stakes may result in increased difficulty in driving the stake. The smooth nature of plastic causes the driving implement to sometimes slip off the head portion of the stake resulting in misalignment of the stake in the ground and possibly damage to the stake. Plastic stakes also tend to be more susceptible to the failure and breakage problems mentioned earlier than are metal stakes.

It is therefore an object of the invention to provide an improved ground stake which overcomes the above limitations.

This and other objects of the invention will be appreciated by reference to the summary of the invention and to the detailed description of the preferred embodiment that follow.

SUMMARY OF THE INVENTION

The improved ground stake according to the invention includes at least one stiffening rib extending along each side of the upper portion of two or more fins to provide additional rigidity to the fins.

The top of the head portion of the stake is provided with an elevated surface to provide additional strength and resistance to wear and deformation when the stake is pounded into the ground. The top of the head portion is further provided with a non-smooth, textured surface to minimize slipping of a pounding implement. The textured surface may be patterned or may be imprinted or embossed with any markings, such as logos, other advertising marks, or identification markings.

At the end of the stake, the fins taper to a crossed tip. The crossed tip configuration provides a broader, blunter end that is radially stronger and less liable to be snapped off, while maintaining the ability to cleanly pierce the ground.

The head portion of the stake comprises a neck portion having opposed recesses thereon for accommodating rope or other elements which may be attached to the stake.

In one aspect, the invention comprises a ground stake comprising a head portion having an upper surface, a base and a neck portion between the upper surface and the base, a plurality of elongated fins depending from the base and terminating at an end, wherein one or more of said fins further comprises a stiffening rib. In a further aspect, the ground stake may comprise four fins equally spaced about the base. In another aspect, the stiffening rib may be on two of the four fins. The two fins with stiffening ribs my be opposed to one another. The stiffening rib may be medially placed on the fin, proximate the base, and may extend longitudinally along the fin from the base toward the end. At least a portion of the fins may taper to a crossed tip at the end.

In another aspect, the invention comprises a ground stake having a head portion comprising an upper surface, a base and a neck portion between the upper surface and the base and a plurality of elongated fins depending from the base and terminating at an end, the fins having at least a portion tapering to a crossed tip at the end.

In another aspect, the invention comprises a ground stake having a head portion comprising an upper surface, a base and a neck portion having an extent between the upper surface and the base, with a recess in a medial portion of the extent and a plurality of elongated fins depending from the underside of the base. In a further aspect, there may be a plurality of recesses. The recesses may be opposed to each other and may be elliptical in shape. In a further aspect, the ground stake may comprise a passageway through the medial portion of the extent, and the passageway may be located between the opposed recesses.

In yet another aspect, the invention comprises a ground stake having a head portion with an upper surface, a base and a neck portion between the upper surface and the base, a plurality of elongated fins depending from the base, and an elevated surface extending above the upper surface, the elevated surface having a rough texture.

In another aspect, the invention comprises a ground stake having a head portion comprising an upper surface, a base and a neck portion between the upper surface and the base, one or more recesses in the neck portion and a plurality of elongated fins depending from the base, wherein one or more of the fins comprises a stiffening rib.

In a further aspect of the invention, the ground stake may further comprise an elevated surface extending above the upper surface, and the elevated surface may have a rough texture.

In yet another aspect, the invention comprises a ground stake having a head portion comprising an upper surface, a base and a neck portion having an extent between the upper surface and the base, and four elongated fins depending from the base and terminating at an end. The fins may have at least a portion tapering to a crossed tip at the end and two of the fins may be opposed to each other and each may further comprise a medial stiffening rib which extends longitudinally along each of the two fins from the base toward the end. There may be two opposed, elliptical recesses in a medial portion of the extent, a passageway through the medial portion of the extent which has a longitudinal axis oriented perpendicular to a second axis between the opposed recesses, and an elevated surface extending above the upper surface, which may have a rough texture.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The preferred embodiment of the invention will be described by reference to the drawings in which.

DETAILED DESCRIPTION OF THE PREFERRED EMBODIMENTS OF THE INVENTION

Figure 1A:
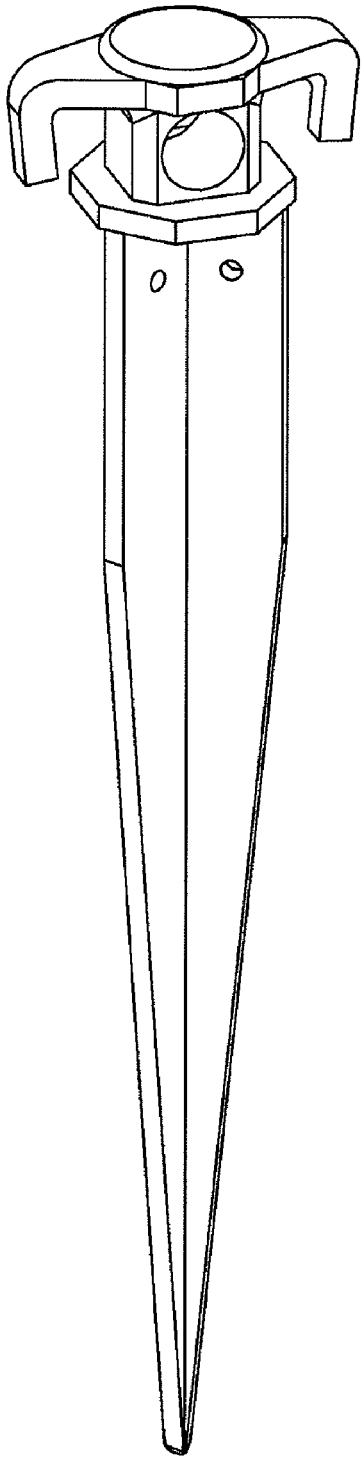
Fig.1a Prior Art
FIGS. 1*a* and 1*b* are perspective views of prior art ground stakes.
Figure 1B:
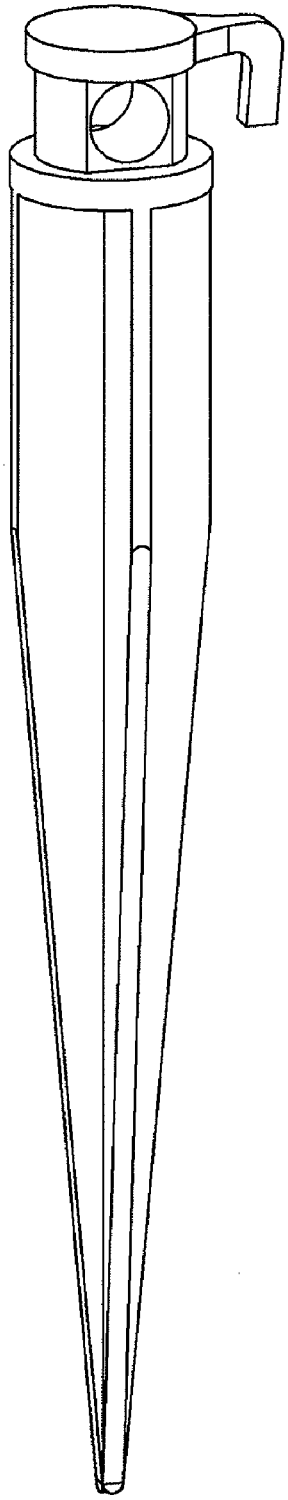
Fig.1b Prior Art
Figure 2:
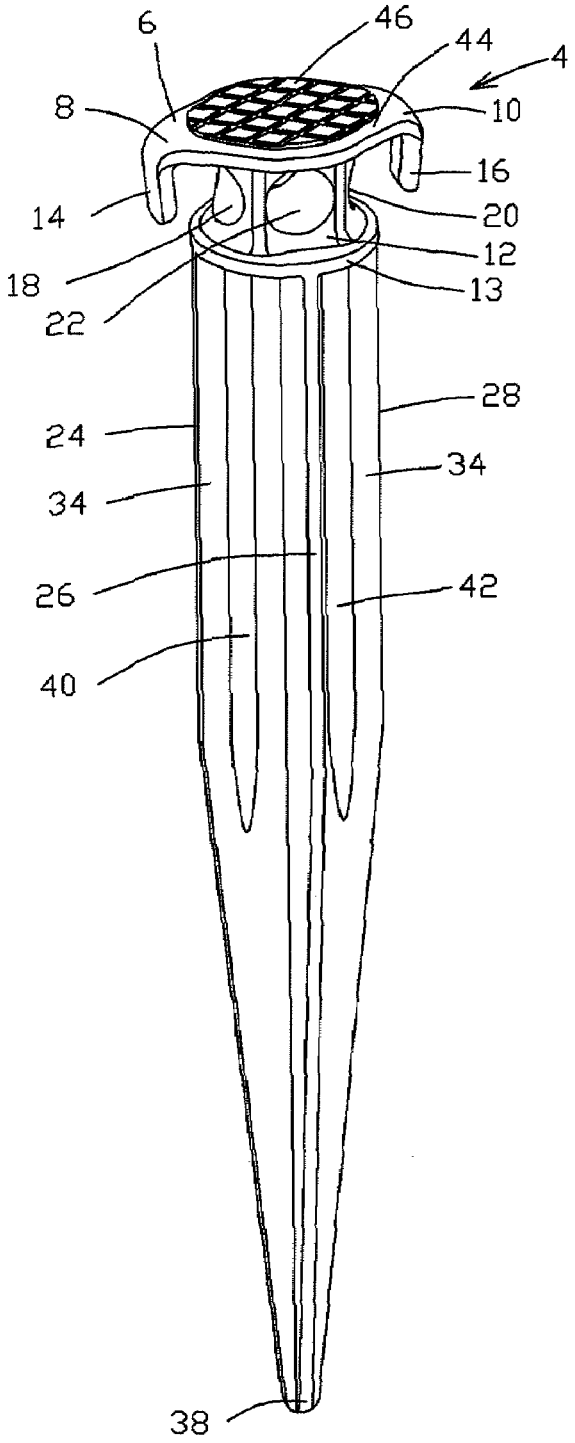
FIG. 2 is a perspective view of the ground stake according to the preferred embodiment.

FIG. 2 is a perspective view of a preferred embodiment of the ground stake 2. Head portion 4 comprises an upper surface 6 with horizontally extending flanges 8, 10 above a neck portion 12 which extends between said upper surface 6 and the base 13 of head portion 4. Flanges 8, 10 terminate in depending legs 14, 16 respectively. Depending legs 14, 16 will interact with the ground once the stake has been pounded into the ground, thereby stabilizing the pounded stake.

The neck portion 12 comprises a passageway 22 through the thickness of the neck portion 12 for attachment to a fastening element such as a rope, cable or bungee cord (not shown). The medial portion of neck portion 12 may also comprise recesses 18, 20, respectively, below the flanges 8, 10. Recesses 18, 20 (best seen in FIGS. 3 and 4) are preferably opposed to each other and passageway 22 is preferably located between the recesses 18, 20. Recesses 18, 20 are preferably elliptical in shape and may be used to secure a fastening element, such as a rope, cable or bungee cord (not shown), to the head portion 4 of the stake 2. Depending legs 14, 16 also assist in retaining such a fastening element around the neck portion 12 and in the recesses 18, 20.

The ground stake 2 further comprises a series of elongated orthogonal fins 24, 26, 28, 30 depending from the base 13 of the head portion 4 below neck portion 12. The preferred embodiment contains four fins, which gives the stake 2 sufficient strength for most applications without unduly adding to the weight and cost of the stake, but it will be understood that the number of fins on a stake is not critical.

Each fin depends from the base 13 of the head portion 4, and is preferably approximately equally spaced around the base 13. In the preferred embodiment, fin 24 is positioned under flange 8, while fin 28 is positioned opposite fin 24, under flange 10. Fins 26, 30 are also opposed, each positioned equidistant from fins 24 and 28. However, it will be understood that the number and exact positioning of the fins may vary.

Figure 3:
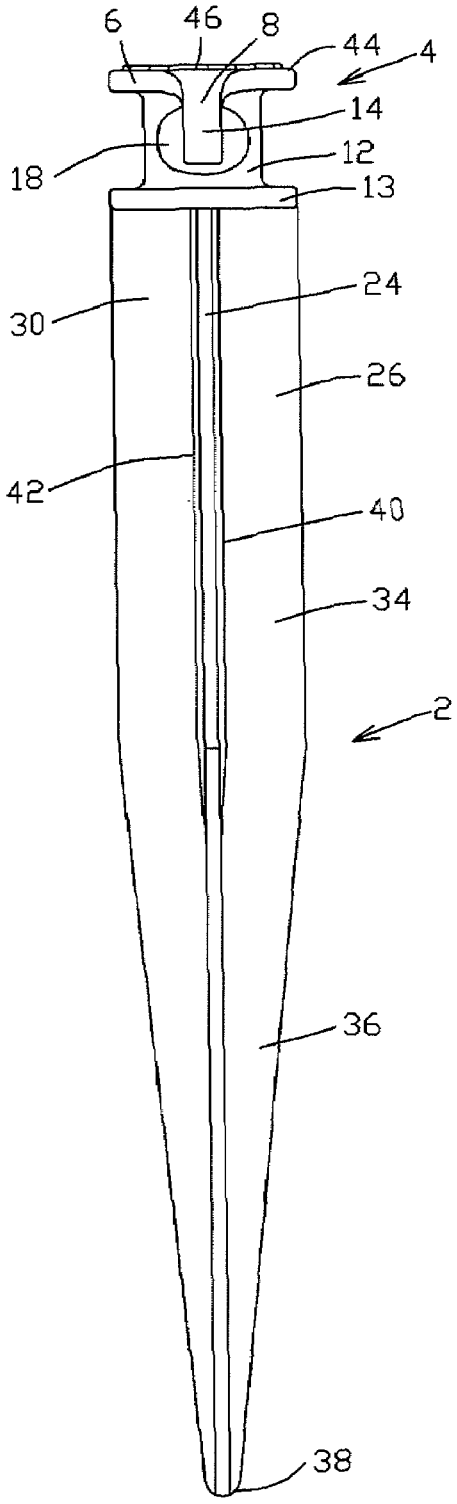
FIG. 3 is a side elevation thereof.
Figure 4:
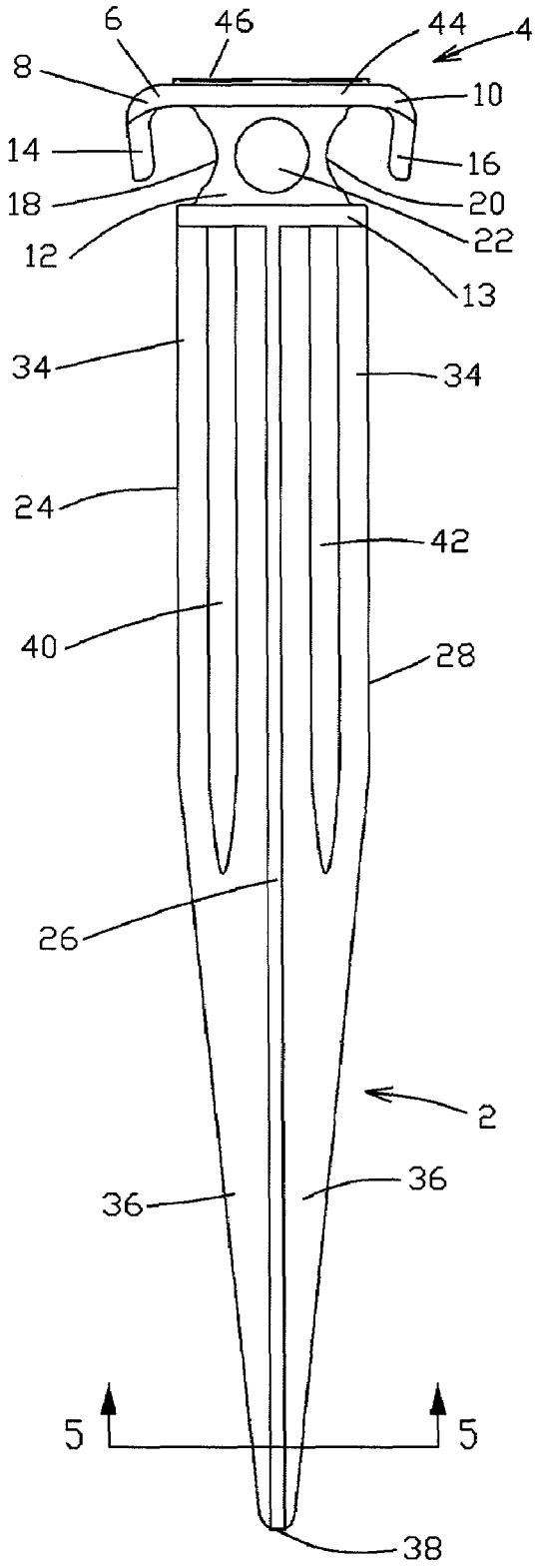
FIG. 4 is a front elevation thereof.
Figure 5:
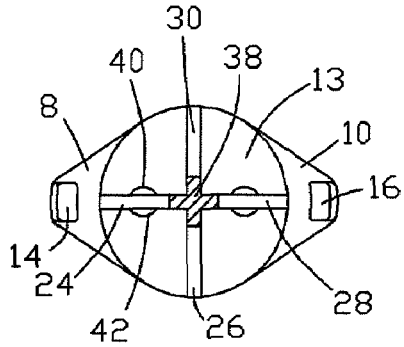
FIG. 5 is a sectional view along line 5-5 of FIG. 4.

As shown in FIG. 3, each fin has at least a portion which tapers, from a thicker upper portion 34 to a narrower lower portion 36. The lower portion 36 of each fin tapers to a truncated blunt end 38 at the bottom of the stake 2. As best seen in FIG. 5, the fins 24, 26, 28, 30 do not taper completely away at blunt end 38, but instead maintain some width and separation from the center of blunt end 38, thus giving the tip the appearance of a cross. The crossed tip configuration renders blunt end 38 radially thicker and stronger than the ends of the prior art stakes, reducing the chances that the end will crack, bend or break if the stake is driven into hard ground or hits a harder substance, such as a rock, under the ground.

One or more of the fins 24, 26, 28, 30 may further comprise a stiffening rib. In the preferred embodiment shown in FIG. 4, fins 24, 28 comprise stiffening ribs 40, 42 medially of upper portion 34, proximate the underside of base 4. Stiffening ribs 40, 42 run longitudinally along fins 24, 28 at least through the thicker upper portion 34, though the stiffening ribs may be any length. A longer stiffening rib 40, 42 will increase the rigidity of the fin 24, 28, while adding a stiffening rib to each of fins 24, 26, 28, 30 will increase the overall stiffness and strength of the stake 2.

Figure 6:
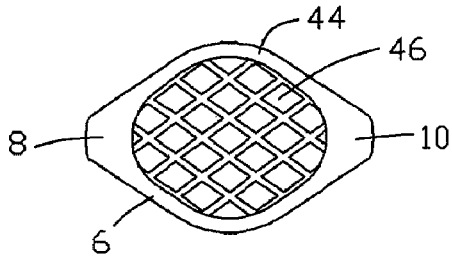
FIG. 6 is a top view of the ground stake according to the preferred embodiment.
Figure 7:
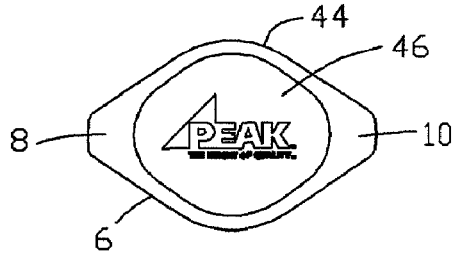
FIG. 7 is a top view of an alternative surface treatment of the head portion of the ground stake according to the preferred embodiment.

As best shown in FIGS. 6 and 7, the top surface 44 of the head portion 4 comprises a surface 46 which is elevated relative to the level of the flanges 8, 10. The elevated surface 46 covers the majority of the top surface 44 and strengthens the top surface 44. The top surface 44 is therefore more resistant to the wear and deformation that typically occurs when the stake 2 is driven into the ground with a pounding implement.

The elevated surface 46 of the head portion 4 is preferably of non-smooth or rough texture, thereby preventing a pounding implement from slipping off the top surface 44 when the stake 2 is being driven into the ground. The elevated surface 46 may be patterned, for example with the pattern shown in FIG. 6. In the alternative, the elevated surface 46 may be imprinted or embossed with a logo or other design, such as for marketing or identification purposes, as shown in FIG. 7.

It will be appreciated by those skilled in the art that other variations to the preferred embodiments described herein may be practiced without departing from the scope of the invention, such scope being properly defined by the following claims.

The invention claimed is:

1. A ground stake comprising:

a head portion comprising an upper surface, a base and a neck portion having an extent between said upper surface and said base, said base having an underside;

first and second elliptical recesses in a medial portion of said extent, said recesses located on opposed sides of said extent;

a passageway through said medial portion of said extent, said passageway located between said opposed recesses and having a centerline axis oriented perpendicular to an a centerline axis passing from a center of said first recess to a center of said second recess;

a plurality of elongated fins depending from said underside of said base and terminating at an end, said fins having an upper non-tapering portion and a lower tapering portion; and one or more of said fins comprising a first stiffening rib; said first stiffening rib comprising a convex protrusion located medially on said fin; said first stiffening rib commencing proximate said base and extending longitudinally along said fin from said base toward said end; said first stiffening rib having a length at least equal to a length of said non-tapering portion.

2. The ground stake of claim 1 wherein said plurality of fins comprises four fins equally spaced about said base.

3. The ground stake of claim 2 wherein a first of said four fins comprises said first stiffening rib, and a second of said four fins comprises a second stiffening rib.

4. The ground stake of claim 3 wherein said first and second fins are opposed to each other.

5. The ground stake of claim 2 wherein said tapering portion tapers to a blunt tip at said end, said tip having a cross-shaped cross-section.

6. A ground stake comprising:

a head portion comprising an upper surface, a base and a neck portion having an extent between said upper surface and said base;

four elongated fins depending from said base and terminating at an end, said fins having an upper non-tapering portion and a lower tapering portion;

said tapering portion tapering to a blunt tip at said end, said tip having a cross-shaped cross-section;

two of said fins being opposed to each other and each further comprising a first stiffening rib; said first stiffening rib being a convex protrusion located medially on said fin; said first stiffening rib commencing proximate said base and extending longitudinally along each of said two fins from said base toward said end; said first stiffening rib having a length at least equal to a length of said non-tapering portion;

first and second elliptical recesses in a medial portion of said extent, said recesses located on opposed sides of said extent;

a passageway through said medial portion of said extent, having a centerline axis said passageway centerline axis being oriented perpendicular to a centerline axis passing from a center of said first recess to a center of said second recess; and an elevated surface extending directly upward from said upper surface; said elevated surface extending from a majority of said upper surface; said elevated surface having a rough texture.

7. The ground stake of claim 1 further comprising an elevated surface extending directly upward from a majority of said upper surface.

8. The ground stake of claim 7 wherein said elevated surface has a rough texture.

9. The ground stake of claim 4 wherein said first fin comprises a third stiffening rib and said second fin comprises a fourth stiffening rib, said third and fourth stiffening ribs located on an opposite side of said first and second fins from said first and second stiffening ribs, wherein said second, third and fourth stiffening ribs are a convex protrusions located medially on said first or second fin, said second, third and fourth stiffening ribs commencing proximate said base and extending longitudinally along said first or second fin from said base toward said end, and said second, third and fourth stiffening ribs having lengths at least equal to said length of said non-tapering portion.

10. The ground stake of claim 6 wherein said two fins each comprise a second stiffening rib located on an opposite side of each of said two fins from said first stiffening rib, wherein said second stiffening rib is a convex protrusion located medially on each of said two fins, commencing proximate said base and extending longitudinally along each of said two fins from said base toward said end, and said second stiffening rib having a length at least equal to said length of said non-tapering portion.

* * * * *